United States Patent [19]

Biller et al.

[11] Patent Number: 4,848,124

[45] Date of Patent: Jul. 18, 1989

[54] MAKING SEAMLESS PIPES, OVER 200 MM IN DIAMETER

[75] Inventors: Horst Biller, Muelheim; Manfred Bellmann, Ratingen; Wilhelm Nickel, Muelheim/Ruhr; Rolf Kuemmerling, Duisburg, all of Fed. Rep. of Germany

[73] Assignee: Mannesmann AG, Duesseldorf, Fed. Rep. of Germany

[21] Appl. No.: 173,139

[22] Filed: Mar. 24, 1988

[30] Foreign Application Priority Data

Mar. 27, 1987 [DE] Fed. Rep. of Germany ..... 3710193

[51] Int. Cl.[4] ..... B21B 19/04

[52] U.S. Cl. ..... 72/97

[58] Field of Search ..... 72/95, 96, 97

[56] References Cited

U.S. PATENT DOCUMENTS 1,994,713 3/1935 Jackson ..... 72/96

2,025,148 12/1935 Bannister ..... 72/97

FOREIGN PATENT DOCUMENTS 522868 7/1976 U.S.S.R. ..... 72/97

*Primary Examiner*—Lowell A. Larson

*Attorney, Agent, or Firm*—Ralf H. Siegemund

[57] ABSTRACT

Seamless tubing and pipes are made from solid rounds with a diameter not exceeding 0.8 of the diameter of the tubing or pipe to be made; the method includes the steps of piercing the solid with a mandrel such that a conical widening angle at the end of piercing has a particular value; a smoothing step is provided downstream from the piercing also with a particular cone angle; and between the piercing and the smoothing of the now pierced hollow is widened under reduction of the wall thickness at a conical angle of widening that is larger (blunter) than the widening angle of piercing and the particular cone angle.

4 Claims, 2 Drawing Sheets

MAKING SEAMLESS PIPES, OVER 200 MM IN DIAMETER

BACKGROUND OF THE INVENTION

The present invention relates to the making of seamless tubes and pipes with a diameter in excess of 200 mm by means of piercing solid rounds or round billets with a d=0.8 of the diameter of the tube or pipe to be made and also including sizing and smoothing of the pierced billet. In addition the invention relates to structure for making such tubes using two roll oblique rolling mills with stationary guides provided in between twin conical rolls and cooperating with an axially movable and adjustable conical mandrel, the mandrel having several sections that differ in diameter and conicity.

Methods generally and equipment of the kind to which the invention pertains have been known for some time. Since the invention of oblique rolling for piercing of solid rounds one has tried to manufacture directly sufficiently thin wall smooth tube by means of such mills. Unfortunately the practice has not yet been able to verify proposals along that line. Tn more than 100 years of development the manufacture of seamless tubing has always included a plurality of steps using stretching and the like or one provided for widening and expansion of the tube diameter for which particular devices and equipment was needed. Among that equipment for providing these tasks are, e.g. so-called pilgrim step rolls, but also plug mills, continuous longitudinal rolling machines etc.

Aside from the foregoing certain proposals have been made to improve the quality of the tubing to be made under utilization of oblique rolling. German Pat. No. 886,437 suggests that a so called reducing roll portion be interposed between the piercing and transverse rolling part within the oblique rolling mill, and the smoothing and the sizing portion of the mill on the other hand.

It is from a point of view of forming technology rather undesired to reduce the wall thickness in reducing mills while maintaining the diameter at the same value, and to provide in a subsequent smoothing part further rolling under utilization of a cylindrical mandrel, that acts against the kinematic conditions in that area. Also, it is believed that the manufacture of seamless tubes and pipes has not really been successfully practiced with any kind of oblique rolling mill, nor is it believed that more than two rolls can be used. This often remained an unconsidered fact so that the subsequent rolling procedure was necessary.

DESCRIPTION OF THE INVENTION

It is an object of the present invention to avoid the drawbacks and disadvantages outlined above and to provide for oblique rolling of seamless tubing and pipes in such a precise manner that stretching or widening of a hollow can be avoided.

In accordance with the preferred embodiment of the present invention it is therefore suggested to widen the pierced hollow between the piercing and a subsequent smoothing, to thereby reduce the wall thickness of the pierced wall hollow through widening onto a cone angle that is larger than the angle under which piercing was terminated as well as larger than the angle used for smoothing. Hene, the piercing mandrel has three portions, a frontal piercing portion, a truncated smoothing portion, and in between a widening cone portion having a conical angle which is larger than the end portion of the piercing portion and of the smoothing portion.

The invention does not claim to provide a solution that is universally applicable for all dimensions under which seamless tubing and pipes are to be made. The range being envisioned is the range of tube diameter in excess of about 200 mm with probably about 600 mm being the upper limit. Within that range the invention provides for a technically controllable solution to the problem. The selection of this range is not arbitrary but was a decisive contribution since previous suggestions that were not successfully practiced were either directed towards smaller diameters or did not consider the diameter of the tubing to be of any significance. The specific limitations posed here with regard to the diameter mean that a particular advantageous flow of material is being used and that aspect is based on the fact that the medium axial speed component of the material at the rolls in the transverse rolling portion as well as in the smoothing portion are at least approximately similar.

The invention uses an expansion through a relatively blunt mandrel portion, i.e. the angle is larger than the rear-most conical angle of the piercing top, and is effective in the transverse portion of rolling. The cone angle is referenced here not only to the cone angle at the piercing part, but also to the cone angle at the smoothing part. The mandrel will preferably have a rounded transion to the smoothing portion. This aspect is to be seen as a significant advantage as compared with shoulder calibration for uniform tube diameter from piercing part to shoulder calibration part and smoothing part in a known structure. Moreover, the stationary guides exhibit an increasingly larger opening than rolls in the section between piercing and smoothing.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding to the detailed description of the drawings, FIG. 1 illustrates a rolling mill with barrel-shaped rolls and a solid billet that runs in the direction of arrow 3. The mill is specifically comprised of two twin cone rolls 1 and 2 which rotate uniformly about axes which, in turn, are actually obliquely related to each, other but projecting these axes into the plane of the drawing, the projections are parallel or slightly directed towards each other in direction of rolling. These rolls, 1 and 2, are driven in a manner known per se. The axes are not actually positioned in the plane of the drawing but cross each other so that in fact the rolled stock will advance in the direction 3. Guide structure is provided between the rolls outside the rolling axis which, in this drawing, is not shown. FIG. 3 will show such guides.

Figure 1:
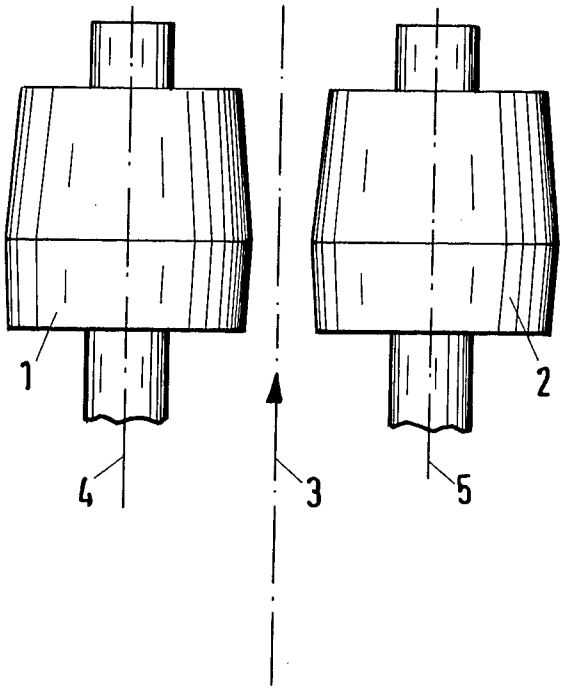

FIG. 2 illustrates a different kind of rolling mill wherein a solid runs in the direction of arrow 6 and is being subjected to the force of these obliquely positioned conical rolls. The double or twin conical rolls 7 and 8 are provided with axes 9 and 10. Just as shown in FIG. 1, the axes cross with the plane of the drawing so that, again, an advance obtains in the direction of arrow 6. The axes have a spreading angle delta in the projection; the two cones 7 and 11 taper in the same direction, i.e. the two truncated cone peaks are on the same side, as far as the conical configuration itself is concerned.

Figure 2:
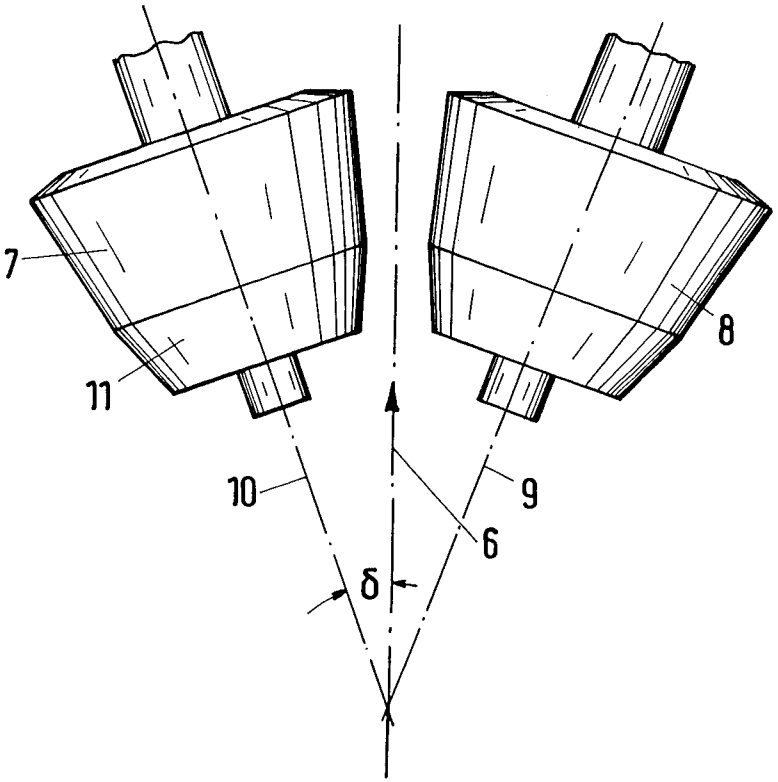
FIGS. 1 and 2 show side elevations of rolls in two different rolling mills.
Figure 3:
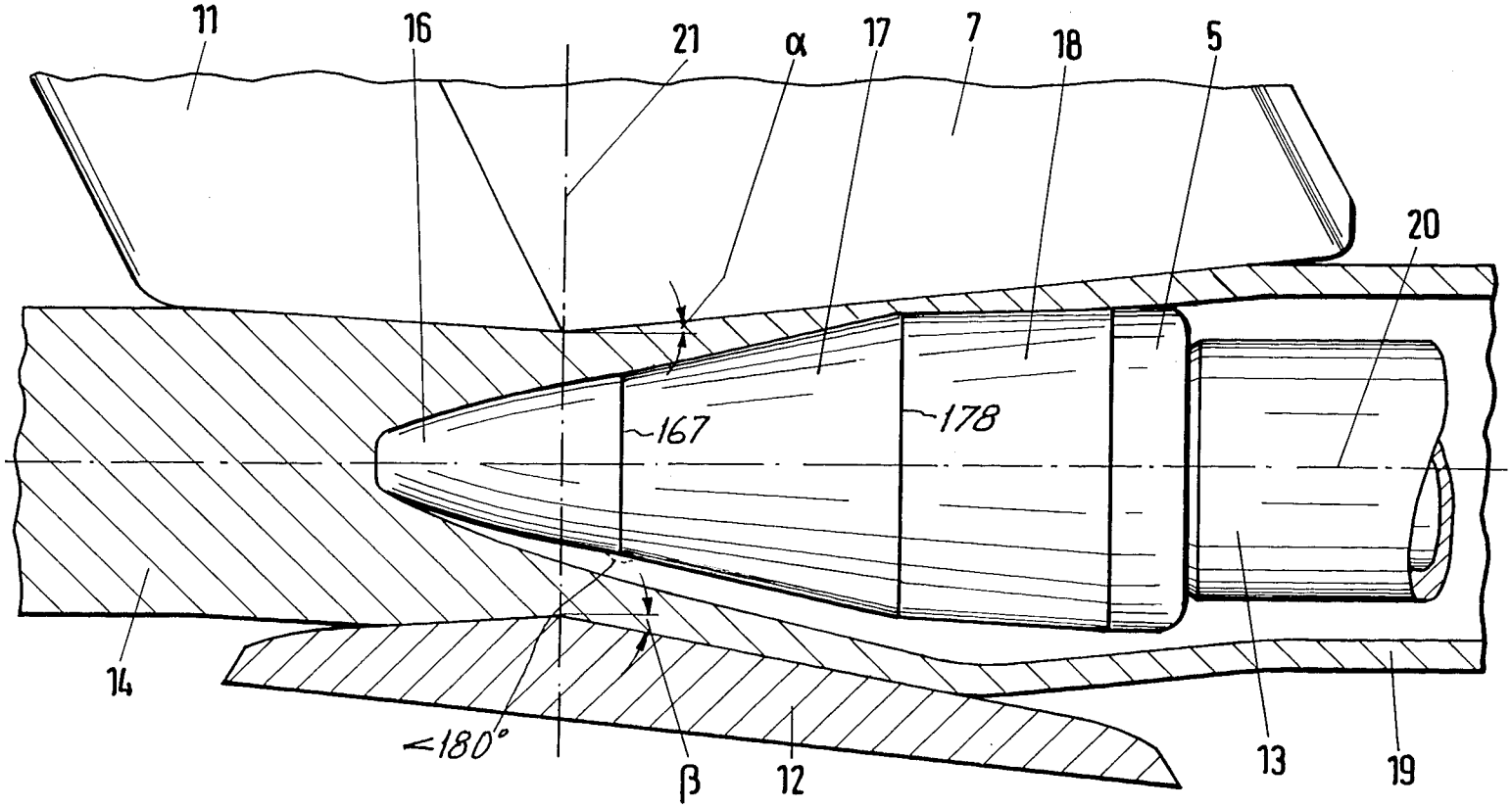
FIG. 3 is a section view through two planes intersecting at right angles, illustrating piercing, rolling, as well as guiding and expansion process.

FIG. 3 illustrates what happens in between the rolls, such as 7 and 8 of FIG. 2. The upper half of FIG. 3 shows a section that runs through the rolls 9 and 11. The section as shown is just through the arrangement shown in FIG. 2. That means the process being illustrated operates with spread roll axes. The billet is identified by 4 and the completed tubing which is smooth is identified by reference numeral 19.

The lower portion of the drawing is 90 degrees turned in relation to the axis. Particular lineal guide 12 are provided at a 90° offset between the rolls 7 and 8, so that one such guide is now visible in this lower section. FIG. 2 is deemed to be the representative general figure while the roll axis 20 in FIG. 3 corresponds to the axis on arrow 6 in FIG. 2 and, of course, can also be understood to represent arrow 3 of FIG. 1.

A mandrel 13 is provided in the roll axis 20, and here a particular mandrel is provided in between the two rolls. The mandrel is comprised of a front portion that constitutes the piercing cone 16; that conical portion is followed by a widening one 17 which, in turn, is followed by a smoothing cone 18. It can readily be seen that piercing portion 16 is of overall conical shape, but has a rounded contour which can be understood to define progressively decreasing cone angles. At the tip, the cone angle is 180°, the cone angle is small at the transition line 167, where the tube widening section 17 begins.

That section or mandrel portion 17 has a uniform cone angle which is larger than the cone angle of 16 at the transition 167. Thus, there is a jump to a large cone angle at that point; transition 167 is equivalent to an inflexion. A transition 178 between mandrel portions 17 and 18 has the cone angle again decreasing, more or less by a step. Of course, either transition may be smoothed or rounded. The mandrel is rounded at 15. The mandrel will be held through the mandrel rod 13 which, in fact, is mounted in a thrust mount (not shown) that is axially adjustable. During rolling the mandrel is used for maintaining a uniform wall thickness and is retracted for taking the rolled stock out of the mill.

FIG. 3 shows exit angles alpha on the roll and an exit angle beta as far as the guide 12 is concerned. The roll exit alpha is specifically important. It is measured in the plane that includes the axis of rolling (28) as well as the axis of the respective roll, the angle being taken in forward direction from the plane 21. The angle beta is taken in the 90° phase shift plane that includes also the rolling axis 20. These angles are situated in the plane of the drawing. It is now specifically required that beta is about twice as large as alpha. Owing to this feature the tube or pipe may originally have a rather large ovality and a rather thin but uniform wall thickness on expansion. Upon smoothing, the reduction in wall thickness is made smaller, and the tube or pipe will assume as more circular cross section corresponding to the increasing diameter of the mandrel. On smoothing the usual conditions have to be maintained that a mandrel conicity results such that the cross-section of the tubing after about half revolution lifts off the stationary guide elements 12.

It can, thus, be seen that the solid billet is shifted and forced by the front portion and cone 16 of roll 7, up to the plane of smallest cross-section (21) from the billet in radial direction, which is a high point of the rolls. The billet is pierced through the mandrel's frontal peak 16. At this point ovalization of the hollow begins and is enhanced in the widening transverse part 17. In order to obtain a thin wall the ovalization must be considered through different exit angles. At the same time the advance component on the hollow increases with increasing diameter of roll 7.

The guides, such as 12, are provided with a widening angle such that adjacent the widening portion 17 of the mandrel, widening of the wall is larger than adjacent to portion 7 of the roll. As soon as the radial pressure of the tube in section 18 is relieved, the tube or pipe becomes more round and smooth while the wall thickness remains the same.

The tubing made on an oblique rolling mill is thus deemed to be complete and has adequate qualities as a product for production of high quality surfaces and for tight diameter tolerances sizing or smoothing mill may be provided in addition with a mandrel with expansions in the range from 2 to 4%.

The invention is not limited to the embodiments described above but all changes and modifications thereof, not constituting departures from the spirit and scope of the invention, are intended to be included.

We claim:

1. Method of making seamless tubing and pipes by means of piercing solid rounds with a diameter not exceeding 0.8 of the diameter of the tubing or pipe to be made, including the steps of:

piercing the solid with a mandrel such that a conical widening angle at the end of piercing has a particular value;

providing downstream from the piercing a smoothing step, with a particular cone angle; and providing between the piercing and the smoothing a widening of the non-pierced hollow under reduction of the wall thickness of the pierced hollow, and at a conical angle of widening that is larger (blunter) than said widening angle and also larger than said particular cone angle.

2. In a piercing mill, having rolls for piercing solid rounds to obtain hollow billets, under utilization of a mandrel, the improvement comprising:

the mandrel having a first frontal piercing cone with a particular rear cone angle that is smaller than any other cone angle of the piercing cone, the mandrel having a conical smoothing portion with a particular cone angle, and a conical widening portion with a cone angle that is larger (blunter) than the rear cone angle and the particular cone angle.

3. The improvement as in claim 2, there being a stationary guide adjacent the mandrel having a progressively larger opening angle than the rolls have.

4. The improvement as in claim 3, an exit angle at the guide being about twice as large as an exit angle at the rolls, radially adjacent to said widening portion of the mandrel.

* * * * *